US006619757B1

(12) United States Patent
Kammerer

(10) Patent No.: US 6,619,757 B1
(45) Date of Patent: Sep. 16, 2003

(54) TOOL FOR A STREET MILLING, COAL-CUTTING OR MINING MACHINE

(75) Inventor: Karl Kammerer, Fluorn-Winzeln (DE)

(73) Assignee: Betek Bergbau- und Hartmettall-Technik Karl-Heinz Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 09/889,937

(22) PCT Filed: Jan. 21, 2000

(86) PCT No.: PCT/EP00/00464

§ 371 (c)(1),
(2), (4) Date: Oct. 25, 2001

(87) PCT Pub. No.: WO00/43596

PCT Pub. Date: Jul. 27, 2000

(30) Foreign Application Priority Data

Jan. 25, 1999 (DE) ..... 199 02 766

(51) Int. Cl.[7] ..... E21B 10/46
(52) U.S. Cl. ..... 299/104; 299/107
(58) Field of Search ..... 299/104, 106, 299/107; 175/425, 427, 428, 432

(56) References Cited

U.S. PATENT DOCUMENTS

| | | | | | |
|---|---|---|---|---|---|
| 3,746,396 A | | 7/1973 | Radd | | |
| 4,660,890 A | * | 4/1987 | Mills | ..... | 299/104 |
| 4,688,856 A | * | 8/1987 | Elfgen | ..... | 299/104 |
| 4,844,550 A | * | 7/1989 | Beebe | ..... | 299/107 |
| 4,932,723 A | * | 6/1990 | Mills | ..... | 299/104 |
| 6,113,195 A | * | 9/2000 | Mercier et al. | ..... | 299/104 |
| 6,164,728 A | * | 12/2000 | Sollami | ..... | 299/104 |

FOREIGN PATENT DOCUMENTS

| | | | | | |
|---|---|---|---|---|---|
| DE | 3242127 A1 | * | 5/1984 | ..... | H04N/5/18 |
| DE | 3439491 A1 | * | 4/1986 | ..... | E01C/23/06 |
| DE | 3630444 A1 | * | 3/1988 | ..... | E21C/25/38 |
| DE | 9213528 U1 | * | 1/1993 | ..... | E21C/25/38 |
| DE | 29623215 U1 | * | 1/1998 | ..... | E21C/35/18 |
| DE | 19720635 A1 | * | 11/1998 | ..... | E21C/35/18 |
| EP | 020 037 | | 8/1984 | | |
| EP | 0 413 917 | | 2/1991 | | |

* cited by examiner

*Primary Examiner*—David Bagnell
*Assistant Examiner*—Daniel P Stephenson
(74) *Attorney, Agent, or Firm*—Pauley Petersen Kinne & Erickson

(57) ABSTRACT

A tool for a street milling, coal-cutting mining machine or the like which includes a chisel with a chisel head and a chisel stem. The chisel stem is rotatably mounted in a receiver of a chisel holder. A perforated wearing protection element is mounted on the chisel head. The chisel head sits closely on the chisel holder while embracing the interposed wearing protection element. This invention achieves improved wearing protection behavior of such a tool. Thus, the inventive wearing protection element has one or more spring elements that elastically support the chisel head by way of the chisel holder.

12 Claims, 2 Drawing Sheets

TOOL FOR A STREET MILLING, COAL-CUTTING OR MINING MACHINE

BACKGROUND OF THE INVENTION

1. Field of the Invention

This invention relates to a tool for a street milling, coal-cutting, mining machine or the like which has a chisel with a chisel head and a chisel shaft. The chisel shaft is rotatably mounted in a receiver of a chisel holder. A perforated wear protection element is mounted on the chisel head with the chisel head sitting closely on the chisel holder with the wear protection element interposed.

2. Description of Related Art

A tool is known from European Patent Reference EP 0 413 917 A1, where the wear protection element is formed as a circular steel sheet disk, from which an opening is punched in the center. The opening is extended in the direction of the chisel head. A chamfered part of the chisel head lies in this extension. The wear protection element lies flat on a contact surface of the chisel holder. During use of the tool, waste material can get past the chisel head and the wear protection element and reach the receiver. In this position, this material can block the free rotation of the chisel.

Another tool for mounting a chisel on a chisel holder is known from European Patent Reference EP 0 200 37 B1, where the chisel head is set directly on the chisel holder. The chisel holder is designed to be under spring tension on a base part that can be attached on its side to a milling roller. The chisel can also become fixed due to waste material penetrating into the receiver, and then the chisel can no longer rotate freely.

SUMMARY OF THE INVENTION

One object of this invention is to provide a tool of the above mentioned type, which has good wear behavior.

The wear protection element comprises one or more spring elements that elastically support the chisel head relative to the chisel holder.

Due to the spring-tensioned support of the chisel head, intermittent forces acting on the chisel are damped so that excessive material stresses are prevented. In addition, the spring force provides an axial play for the chisel, wherein the chisel head can then also move axially in the receiver of the chisel holder. With this axial play, there is a type of "pump effect" which can extract waste material that has reached the region of the receiver. Thus, the free rotation of the chisel can be maintained.

In order to keep the cost of parts and assembly to a minimum, according to a preferred embodiment of this invention, spring elements are formed integrally with the wear element.

In one possible embodiment of this invention, the wear protection element comprises a base part with at least one flat contact surface that contacts an opposing surface of the chisel head or the chisel holder. A circumferential section acting as a spring element is bent in the direction of the chisel holder or the chisel head from the base part. The spring element supports the chisel holder or the chisel head on the region of the spring element facing away from the base part.

However, it is also conceivable for several, preferably three, spring elements that are separated from each other to be bent from the base part. With these spring elements, a definite, statically determinate support situation is achieved.

In order to be able to achieve progressive or regressive spring characteristics, according to one embodiment of this invention, each spring element comprises two or more spring sections that exhibit different spring rigidity and/or the same or different spring deflections.

A tool according to this invention has an area around the opening in which the chisel shaft is inserted, with a circumferential centering attachment that projects in the direction of the chisel holder and that interacts with a centering extension of the receiver of the chisel holder. The centering extension of the chisel holder simplifies assembly of the chisel shaft in the receiver. During operation, the region of the contact surface on which the wear protection element is supported and which is arranged around the receiver gradually wears away. This is caused by rotation of the wear protection element on this contact surface. With a centering attachment at the wear protection element, the centering extension is worn away to the same degree as the contact surface. However, this causes the centering extension to remain in place.

A tool with a simple configuration and that is cost-effective to produce is obtained according to this invention when the wear element is produced as a stamped, bent part from a flat material blank, from which the opening for the chisel shaft is punched and whose edge or edges are bent for completely or partially forming the spring elements.

Here, one or more reinforcing ribs can be formed on the edges that form the spring elements. The reinforcing ribs increase the spring rigidity. Thus, a relatively low material strength can be used for the wear protection element yet still provide a high spring rate.

BRIEF DESCRIPTION OF THE DRAWINGS

This invention is explained in more detail in view of the drawings, wherein.

DESCRIPTION OF PREFERRED EMBODIMENTS

Figure 1:
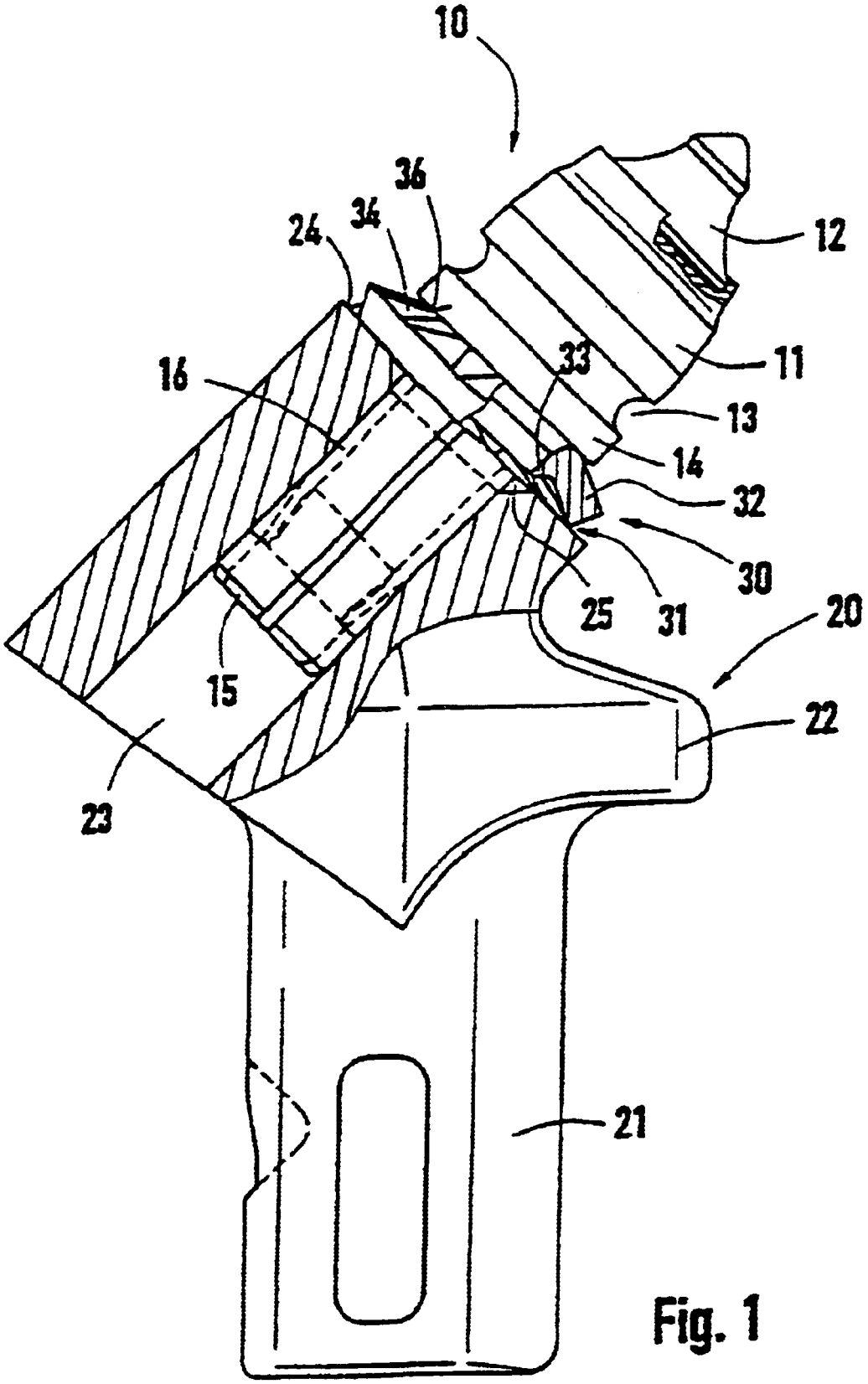
FIG. 1 is a chisel holder with an attached tool in a side view and partial cross section.

FIG. 1 shows a chisel holder 20 with a base part 22. The base part 22 carries a plug attachment 21 that can fix the chisel holder 20 to a holder part so that it can be removed. The holder part can then be attached to a milling roller or a coal-cutting machine or the like. For the sake of clarity, the holder part and the milling roller are not shown in FIG. 1. The base part 22 has a receiver 23. The receiver 23 is bored into the base part 22 starting from a level contact surface 24. The receiver 23 expands outwards by means of a centering extension 25 at the contact surface 24. A chisel 10 is fixed to the chisel holder 20. The chisel 10 comprises a chisel head 11 and a chisel shaft 15. The chisel head 11 has a receiver on its front side, in which a bit 12 is soldered. In an intermediate region, the chisel head 11 has a circumferential groove 13 that enables the disassembly of the chisel 10 from the chisel holder 20, with a tool. In the transition region to the chisel shaft 15, the chisel head 11 is sealed with a flange 14. As shown in FIG. 1, an adapter sleeve 16 is mounted on the chisel shaft 15. The adapter sleeve 16 holds the chisel 10 in the axial direction. Furthermore, the adapter sleeve 16 is braced due to radial expansion in the receiver 23 of the chisel holder 20. In this way, the adapter sleeve 16 holds the chisel 10 in the chisel holder 20, wherein the chisel 10 can freely rotate in the adapter sleeve 16. Between the chisel head 11 and the chisel holder 20 there is a wear protection element 30. The wear protection element 30 supports the chisel head 11 on the contact surface 24 of the chisel holder 20.

The wear protection element 30 is produced as a stamped, bent part from a circular steel sheet blank and has a centering opening 35, by which the wear protection element 30 is mounted on the chisel shaft 15. In a region facing the chisel head 11, the opening 35 tapers into an expanding, chamfered inlet 37. The chamfered inlet 37 serves for easier assembly of the wear protection element 30. The wear protection element 30 is initially loaded onto the end of the adapter sleeve 16 with its chamfered inlet 37 facing away from the chisel head 11. Thus, the diameter ratio of the opening 35 of the wear protection element 30 relative to the tensioned diameter of the adapter sleeve 16 is selected so that the adapter sleeve can be inserted into the receiver 23 with minimum or no force. For final assembly of the chisel 10, the wear protection element 30 is shifted by the application of force, for example, by means of hammer blows, along the adapter sleeve 16 until it goes beyond the end of the adapter sleeve 16 on the side of the chisel head. Then the adapter sleeve 16 is snapped in radially and is tensioned in the receiver 23. In this assembled position, the chisel head 11 contacts the contact surface 36 of the wear protection element 30. The contact surface 36 extends perpendicularly to the center longitudinal axis of the chisel 10 and connects to the chamfered inlet 37. In the region of this contact surface 36, the wear protection element 30 forms a base part, from which a spring element 32 is bent projecting outwards. The spring element 32 is formed from the outer edge of the wear protection element 30 which is placed at an angle to the contact surface 24 of the chisel holder 20. The spring element 32 is supported at its end facing away from chisel head 11 by means of a support section 31 on the contact surface 24 of the chisel head 20. As shown in FIG. 1, the wear element 30 has a circumferential centering attachment 33 designed with a geometry that makes a 45° angle with the chisel holder 20, wherein this angle continues around the receiver 23 as the centering extension 25. The centering extension 25 simplifies mounting of the chisel 10 in the receiver 23. As shown in FIG. 1, the centering attachment 33 in its original state, not attached to the tool, is arranged at a distance to the centering extension 25. This separation creates a spring deflection. If a tool, for example for a road surface, is attached to the tool of this invention, then the impact of the bit on the material to be removed is cushioned by the spring element 32 of the wear protection element. In this way, excessive material stresses on the bit 12 are prevented. During the removal process, the wear protection element 30 is flattened. After the tool is detached, the wear protection element 30 springs back into its output position, wherein the chisel shaft 15 is shifted along its axial direction in the receiver 23. Due to this "pump effect," waste material which gets past the chisel head 11 and the wear protection element 30 and reaches the receiver 23 can be extracted. Thus, the free rotation of the chisel 10 in the adapter sleeve 16 is maintained.

In the following, various embodiments of wear protection elements 30 are explained in view of FIGS. 2*a*–4*b*.

Figure 2A:
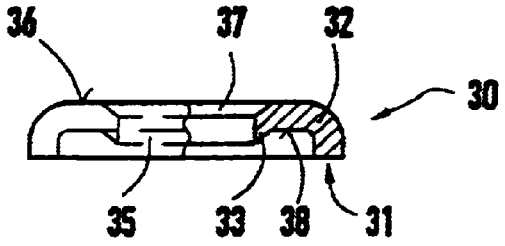
FIG. 2*a* is a wear protection element in a side view and partial cross section.
Figure 2B:
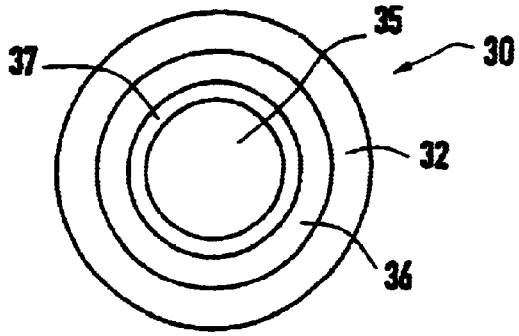
FIG. 2*b* is the wear protection element from FIG. 2*a* in a top view.

The wear protection element shown in FIGS. 2*a* and 2*b* has a spring element 32 that is formed from the outer edge of the wear protection element 30. The edge of the wear protection element 30 is bent so that it runs parallel to the longitudinal extension of the chisel 10. This produces a flat, annular support section 31, by which the wear protection element 30 is supported on the contact surface 24.

Figure 3A:
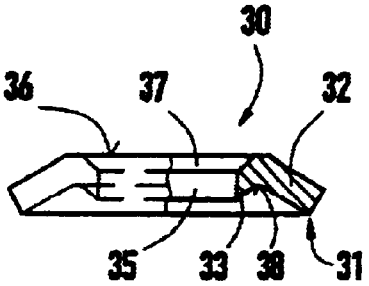
FIG. 3*a* is another embodiment of a wear protection element in a side view and a partial cross section.
Figure 3B:
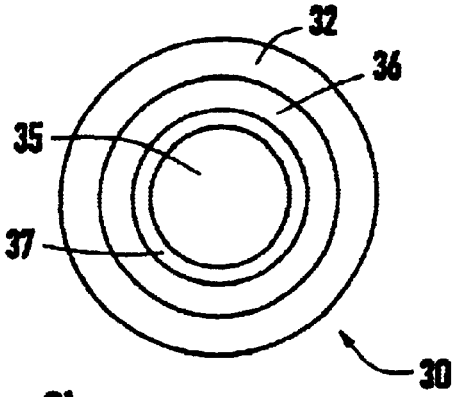
FIG. 3*b* is the sear protection element from FIG. 3*a* in a top view.

A wear protection element 30 is shown in FIGS. 3*a* and 3*b*, having an outer edge not bent 90° as shown in FIGS. 2*a* and 2*b*, but rather at an angle less than 90°.

Figure 4A:
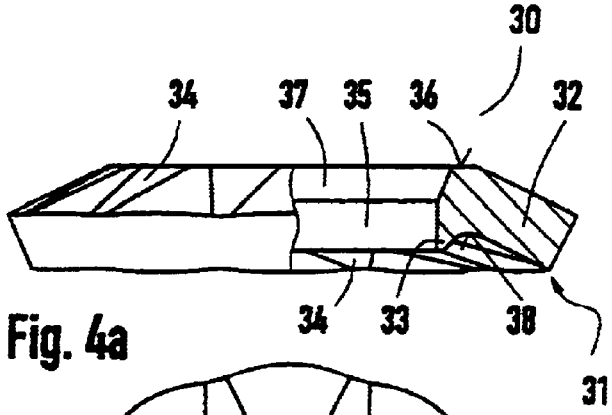
FIG. 4*a* is a modification of the wear protection element shown in FIGS. 3*a* and 3*b* in a side view and partial cross section.
Figure 4B:
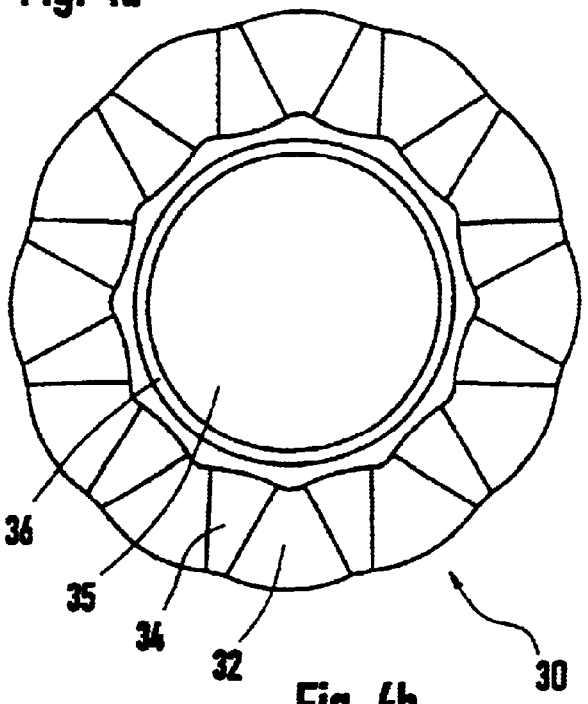
FIG. 4*b* is the wear protection element of FIG. 4*a* in a top view.

In FIGS. 4*a* and 4*b*, the wear protection element 30 in FIG. 1 is shown in more detail. The outer edge that forms the spring element 32 has reinforcing ribs 34. The spring rate of the spring element 32 can be increased by these reinforcing ribs 34.

The production of the wear protection element 30 described above is simple. Here, a circular blank is first punched from a flat steel sheet blank. The opening 35 can be punched from the steel sheet blank. Then the region surrounding the opening 35 is stamped-so that the centering attachment 33 and the chamfered inlet 37 are obtained simultaneously. Then the spring element 32 is bent.

What is claimed is:

1. In a tool for a milling, cutting, or mining machine, having a chisel head and a chisel shaft, wherein a chisel is rotatably mounted in a receiver of a chisel holder, a perforated wear protection element is mounted on the chisel head with the chisel head sitting closely on the chisel holder with a wear protection element interposed, the improvement comprising: the wear protection element (30) having at least one spring element (32) elastically supporting the chisel head (11) relative to the chisel holder (20), the wear protection element (30) having a base part with at least one flat contact surface that contacts an opposing surface of one of the chisel head (11) and the chisel holder (20), at least two of the spring elements (32) bent from the base part in the direction of one of the chisel holder (20) and the chisel head (11), and the spring elements (32) supporting one of the chisel holder (20) and the chisel head (11) in a region of the spring elements (32) facing away from the base part (22).

2. In the tool according to claim 1, wherein the at least one spring element (32) is integrally formed with the wear element (30).

3. In the tool according to claim 2, wherein the wear protection element (30) has a base part (22) with at least one flat contact surface (36) that contacts an opposing surface of one of the chisel head (11) and the chisel holder (20), a circumferential section serving as a spring element (32) is bent from the base part in a direction of one of the chisel holder (20) and the chisel head (11), and the spring element (32) supports one of the chisel holder (20) and the chisel head (11) in a region of the spring element (32) facing away from the base part (22).

4. In the tool according to claim 3, wherein the spring element (32) has at least two spring sections with different spring rigidities.

5. In the tool according to claim 4, wherein near an opening (35) in which the chisel shaft (15) is inserted a circumferential centering attachment (33) projects towards the chisel holder (20) and interacts with a centering extension (25) of the receiver (23) of the chisel holder (20).

6. In the tool according to claim 5, wherein the wear protection element (30) is produced as a stamped, bent part from a flat material blank, from which the opening (35) is punched for the chisel shaft (15) and has at least one edge bent for at least partially forming the spring elements (32).

7. In the tool according to claim 6, wherein at least one reinforcing rib (34) is formed on edges that form the spring elements (32).

8. In a tool for a milling, cutting, or mining machine, having a chisel head and a chisel shaft, wherein a chisel is rotatably mounted in a receiver of a chisel holder, a perforated wear protection element is mounted on the chisel head with the chisel head sitting closely on the chisel holder with a wear protection element interposed, the improvement comprising: the wear protection element (30) having at least one spring element (32) elastically supporting the chisel head (11) relative to the chisel holder (20), and the spring element (32) having at least two spring sections with different spring rigidities.

9. In the tool according to claim 8, wherein the wear protection element (30) has a base part with at least one flat contact surface that contacts an opposing surface of one of the chisel head (11) and the chisel holder (20), and at least two of the spring elements (32) are bent from the base part in the direction of one of the chisel holder (20) and the chisel head (11), and the spring elements (32) support one of the chisel holder (20) and the chisel head (11) in the region of the spring elements (32) facing away from the base part (22).

10. In the tool according to claim 8, wherein the wear protection element (30) has a base part (22) with at least one flat contact surface (36) that contacts an opposing surface of one of the chisel head (11) and the chisel holder (20), a circumferential section serving as a spring element (32) is bent from the base part in a direction of one of the chisel holder (20) and the chisel head (11), and the spring element (32) supports one of the chisel holder (20) and the chisel head (11) in a region of the spring element (32) facing away from the base part (22).

11. In the tool according to claim 8, wherein near an opening (35) in which the chisel shaft (15) is inserted a circumferential centering attachment (33) projects towards the chisel holder (20) and interacts with a centering extension (25) of the receiver (23) of the chisel holder (20).

12. In the tool according to claim 8, wherein the wear protection element (30) is produced as a stamped, bent part from a flat material blank, from which an opening (35) is punched for the chisel shaft (15) and has at least one edge bent for at least partially forming the spring elements (32).

* * * * *